US007473282B2

(12) United States Patent
Manning

(10) Patent No.: US 7,473,282 B2
(45) Date of Patent: Jan. 6, 2009

(54) SELF-LIGHTING CANDLE

(76) Inventor: Bertha Manning, 2731 Cokey Rd., Rocky Mount, NC (US) 27801

( * ) Notice: Subject to any disclaimer, the term of this patent is extended or adjusted under 35 U.S.C. 154(b) by 817 days.

(21) Appl. No.: 10/970,551

(22) Filed: Oct. 21, 2004

(65) Prior Publication Data

US 2006/0088795 A1 Apr. 27, 2006

(51) Int. Cl.
*C11C 5/00* (2006.01)
*F23Q 1/00* (2006.01)

(52) U.S. Cl. ..... 44/275; 431/288; 431/289

(58) Field of Classification Search ..... 44/275; 431/289

See application file for complete search history.

(56) References Cited

U.S. PATENT DOCUMENTS

| | | | | |
|---|---|---|---|---|
| 3,046,995 | A | 7/1962 | Christy | |
| 3,272,604 | A | 9/1966 | Tigrett et al. | |
| 3,754,861 | A | 8/1973 | Sadahiro | |
| 4,310,007 | A | 1/1982 | Auersbacher | |
| 4,381,914 | A * | 5/1983 | Ferguson | 431/267 |
| 5,256,059 | A * | 10/1993 | Knippenberg | 431/289 |
| 5,354,197 | A * | 10/1994 | Barone | 431/287 |
| 5,439,376 | A * | 8/1995 | Kramer et al. | 431/287 |
| 6,186,776 | B1 * | 2/2001 | Myerchin | 431/287 |
| 6,680,029 | B2 | 1/2004 | Stanley, III | |
| 7,318,724 | B2 * | 1/2008 | Kubicek et al. | 431/289 |

* cited by examiner

*Primary Examiner*—Ellen M. McAvoy
(74) *Attorney, Agent, or Firm*—Coats & Bennett, P.L.L.C.

(57) ABSTRACT

A self-lighting candle includes a body, a wick and a frictionally flammable head proximate the wick. The frictionally flammable head ignites upon being struck against a rough surface. Heat from the flame of the ignited frictionally flammable head lights the wick. The frictionally flammable head may be formed on the wick itself, either proximate or spaced away from the candle body. Alternatively, the frictionally flammable head may be formed on a structurally rigid member partially embedded in the candle body and separate from the wick. A striking surface suitable for striking the frictionally flammable head may be permanently or removably attached to the candle body. For the first lighting of the candle, no match, lighter, or other external source of flame is necessary.

16 Claims, 1 Drawing Sheet

SELF-LIGHTING CANDLE

BACKGROUND OF THE INVENTION

The present invention relates generally to candles and in particular to a self-lighting candle including a frictionally flammable head.

Man's use of candles, in some form, is nearly as old as his use of fire. Today, candles are utilized for light, decoration and as aromatic delivery devices. Candles are used in many religious and traditional ceremonies, from worship services to the ritual of blowing out of candles on a birthday cake. In addition, candles have important utilitarian functions, such as providing a source of emergency lighting that does not depend on batteries during a power failure, warming food in serving dishes, and the like. Modern candles are available in a dizzying array of shapes, sizes, styles, colors, aromas and features, such as having multiple wicks, colored flames and artistic forms. However, all candles require a separate source of flame, such as a match or cigarette lighter, to light them.

As the habit of smoking declines, many households no longer maintain a ready supply of matches or other lighting devices, such as lighters. Accordingly, an increasingly common experience is the preparation of dinner table, birthday cake, menorah or other decoration or ceremony including candles, only to discover that no matches or other source of open flame is readily available to light the candles.

SUMMARY OF THE INVENTION

In one aspect, the present invention relates to a self-lighting candle. The candle includes a body and a wick at least partially embedded in the body. The candle additionally includes a frictionally flammable head proximate the wick and operative to light the wick when the head ignites. The frictionally flammable head may be formed on the wick, and may be proximate the body or spaced apart from the body. Alternatively, the frictionally flammable head may be formed on a structurally rigid member separate from the wick.

In another aspect, the present invention relates to a method of making a self-lighting candle. The method includes forming a candle body having a wick at least partially embedded therein, and forming a head of frictionally flammable material proximate the wick. The method may additionally include affixing a striking surface to the candle body.

In yet another aspect, the present invention relates to a self-lighting candle. The candle includes a body, a wick partially embedded in the body, and igniting means for lighting the wick by striking the igniting means against a frictional surface.

DETAILED DESCRIPTION OF THE INVENTION

Figure 1:
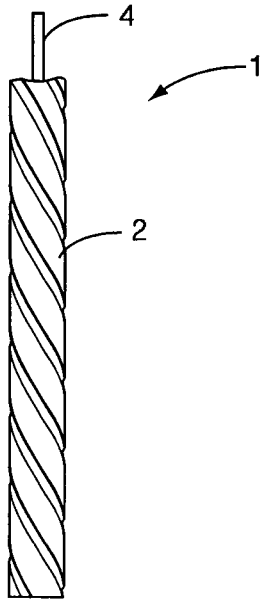
FIG. 1 (PRIOR ART)
FIG. 1 depicts a prior art candle.

A representative traditional candle is depicted in FIG. 1, indicated generally by the numeral 1. As well known in the art, the candle 1 comprises a body 2 and at least one wick 4. The candle body 2 may be formed in virtually any shape or configuration imaginable. The candle body 2 is solid at room temperature, and melts to a liquid phase proximate the wick 4 by heat of a flame on the wick 4, which flame is sustained by the fuel comprising the liquefied candle body 2. The candle body 2 may be formed from any suitable low melting point solid fuel, and is most commonly formed primarily from paraffin wax. Many formulations suitable for a candle body 2 are known in the art, as evidenced by numerous U.S. Patents such as U.S. Pat. Nos. 6,773,469; 6,758,869; 6,641,623; 6,582,484 and 6,551,365. Indeed, candle compositions are so well known in the art that the U.S. Patent and Trademark Office has dedicated class 44/275 to the subject. The candle body 2 may additionally include various dyes, aromatic agents, and/or decorative elements. The traditional candle 1 must be lit by an external source of flame, such as a match or lighter.

Figure 2:
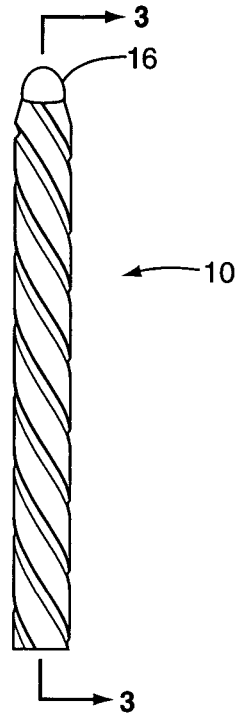
FIG. 2 depicts a candle having a frictionally flammable head on the wick proximate the body.
Figure 3:
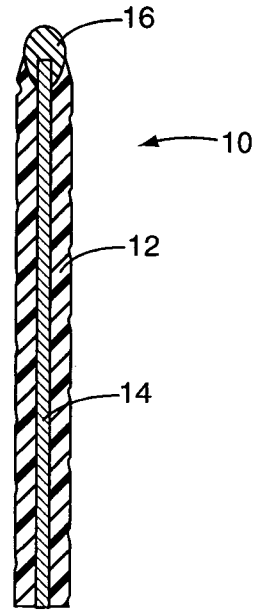
FIG. 3 is a section view of the candle of FIG. 2.

Unlike traditional candles, which must be lit by an external flame source, FIGS. 2 and 3 illustrate an exemplary candle 10 according to the present invention. The candle 10 includes a body 12 and wick 14 as do traditional candles 1. The inventive candle 10 additionally includes a frictionally flammable head 16. While the present invention contemplates several embodiments for frictionally flammable heads 16, in the embodiment illustrated in FIGS. 2 and 3, the frictionally flammable head 16 is formed on or over a portion of the wick 14 extending out of the body 12.

The frictionally flammable head 16 may comprise a bulbous, generally tear-drop shaped mass of pyrotechnic material, of a composition found in conventional match heads, which may for example include a mixture of potassium chlorate and sulfur as active ingredients, and may additionally include various fillers, abrasives, glue and/or dye. Numerous suitable formulations for the frictionally flammable head 16 are known in the art, such as, for example, those disclosed by U.S. Pat. Nos. 3,634,152; 3,650,712; 3,775,198; 4,040,879 and 4,138,225.

When struck, or moved against a rough surface, the frictionally flammable head 16 ignites from the heat of friction, and generates a flame. The flame in turn lights the wick 12, thus lighting the candle 10 without requiring an external source of flame, such as a match or lighter. Note that on candles having multiple wicks, one, some or all of the wicks may include a frictionally flammable head 16.

In one embodiment, the frictionally flammable head 16 is of the type found on "strike-anywhere" matches (also commonly known as "kitchen matches"), which exhibit the feature of igniting when struck against any sufficiently rough surface. In this embodiment, the frictionally flammable head 16 may comprise a two-part or multi-part formulation, as necessary or desired.

Figure 4:
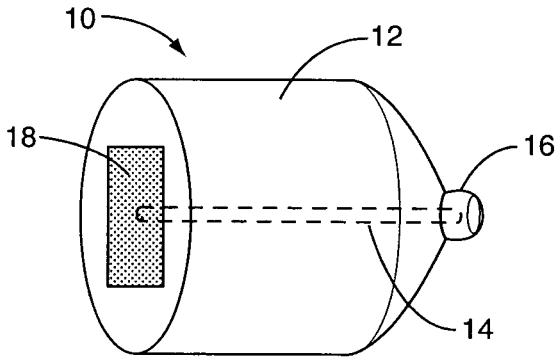
FIG. 4 depicts a candle having a striking surface affixed to the underside of the body.

In another embodiment, the frictionally flammable head 16 is of the type found on conventional book matches, which must be struck against a particular frictional surface provided on the match book or box, or similar surface. In this embodiment, the candle 10 may include a striking surface 18 affixed to the candle body 12, as depicted in FIG. 4. As used herein, the term "striking surface" refers to a surface having a coefficient of dynamic friction in the range sufficient to ignite the frictionally flammable head 16, when the frictionally flammable head 16 is struck, or rubbed against the striking surface 18 for a short distance, such as about one inch.

The striking surface may be affixed in any location or orientation, such as along the length of the candle, or on the underneath side, as shown in FIG. 4. In one embodiment, the striking surface 18 is removably attached to the candle body 12, and may be removed and used to strike the frictionally flammable head 16 to light the candle 10. In another embodiment, the striking surface 18 is permanently affixed to the candle body 12. In this case, the striking surface 18 may not strike the frictionally flammable head 16 of the same candle 10. However, in the usual case that two or more of the candles 10 of the present invention are stored or dispensed together, one candle 10 may be lit by striking its frictionally flammable head 16 against the striking surface 18 of another candle.

Figure 5:
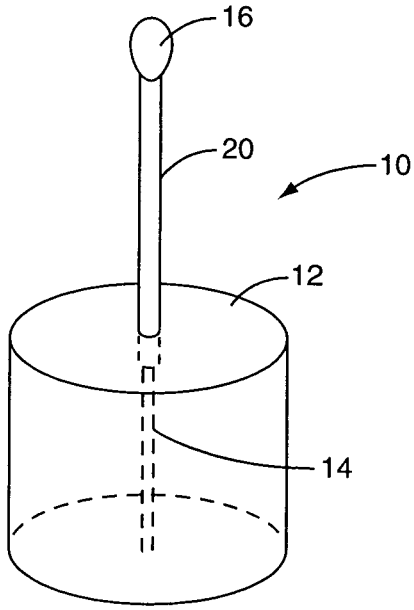
FIG. 5 depicts a candle having a frictionally flammable head on the wick spaced apart from the body.

The frictionally flammable head 16 may be formed over the entire portion of the wick 14 extending from the candle body 12, as depicted in FIGS. 2 and 3. FIG. 5 depicts another embodiment of the present invention, in which the frictionally flammable head 16 is disposed on the wick away from the candle body 12. In this embodiment, at least an exposed portion of the wick may comprise a structurally rigid, flammable member 20 formed from a flammable material such as wood, cardboard or the like. Such structural rigidity may be necessary to facilitate striking the frictionally flammable head 16 against a rough surface or against a striking surface 18. Additionally, the structurally rigid, flammable member 20 may be broken between the candle body 12 and the frictionally flammable head 16 to provide a "match," which may be ignited by striking, and subsequently used to light the wick 14, as well as other candles 10.

In this embodiment, the entire wick 14 may comprise the structurally rigid, flammable member 20. Alternatively, the structurally rigid, flammable member 20 may comprise only an exposed portion of the wick 14 (or any other portion of the wick 14), with the remainder of the wick formed from string, twine, or other traditional wick material.

Figure 6:
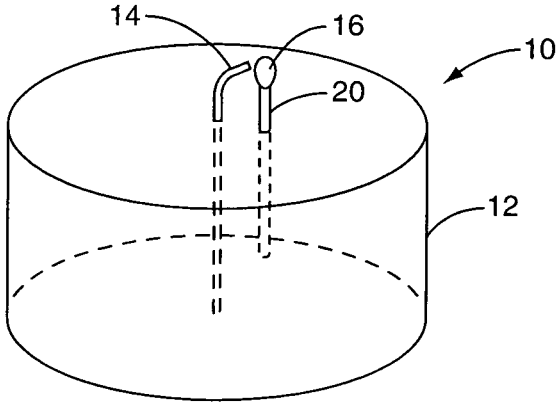
FIG. 6 depicts a candle having a frictionally flammable head on a structurally rigid member separate from the wick.

According to another embodiment of the present invention, depicted in FIG. 6, the frictionally flammable head 16 may be disposed on a structurally rigid member 20 embedded in the candle body 12, separate from the wick 14. The structurally rigid member 20 is preferably disposed such that the frictionally flammable head 16 is proximate or beneath an exposed portion of the wick 14 when the candle 10 assumes its normal orientation (e.g., vertical for a birthday cake candle). Alternatively, the candle 10 may be maneuvered to an orientation that places the wick 14 in contact with or over the flame once the frictionally flammable head 16 has been struck and ignited. Where the structurally rigid member 20 is formed from a flammable material, the structurally rigid member 20 preferably extends only far enough into the candle body 12 to secure it, so as not to provide a second wick that may accelerate burning away the candle body 12. Alternatively, the structurally rigid member 20 may be formed from a non-flammable material, in which case the flame resulting from ignition of the frictionally flammable head 16 will extinguish following lighting the wick 14, when the frictionally flammable head 16 material burns away.

Since the frictionally flammable head 16 may only be struck once, the present invention is particularly suited for single-use candles, such as birthday candles. Another application in which the candle 10 of the present invention may find particular utility is in situations where the first use of a candle 10 is critical, such as emergency candles. However, the self-lighting feature of present invention may be advantageously applied to any candle 10, and provides convenient lighting for at least the first use of the candle 10.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

What is claimed is:

1. A candle, comprising:

a body;

a wick at least partially embedded in said body; and a frictionally flammable head formed on said wick and operative to light said wick when said head ignites.

2. The candle of claim 1 wherein said frictionally flammable head is formed on a portion of said wick not embedded in said body.

3. The candle of claim 2 wherein said portion of said wick not embedded in said body comprises a structurally rigid member.

4. The candle of claim 3 wherein said frictionally flammable head is disposed on said wick spaced apart from said body.

5. The candle of claim 1 wherein said frictionally flammable head ignites upon frictional contact with a rough surface.

6. The candle of claim 1 wherein said frictionally flammable head ignites upon frictional contact with a striking surface.

7. The candle of claim 6 further comprising said striking surface affixed to said body.

8. The candle of claim 7 wherein said striking surface is removably affixed to said body.

9. The candle of claim 7 wherein said striking surface is permanently affixed to said body.

10. A method of making a self-lighting candle, comprising:

forming a candle body having a wick at least partially embedded therein; and forming a head of frictionally flammable material on said wick.

11. The method of claim 10 further comprising affixing a striking surface to said candle body.

12. The method of claim 11 wherein said striking surface is disposed on another candle.

13. The method of claim 10, wherein forming a head of frictionally flammable material on said wick comprises forming a head of frictionally flammable material on a structurally rigid wick member and embedding said structurally rigid wick member at least partially in said candle body.

14. The method of claim 13 wherein said structurally rigid wick member is flammable.

15. A candle, comprising:

a body;

a wick partially embedded in said body; and igniting means on said wick for lighting said wick by striking said igniting means against a frictional surface.

16. The candle of claim 15 wherein said frictional surface is a striking surface.

* * * * *